US007066706B2

(12) United States Patent
Risch et al.

(10) Patent No.: US 7,066,706 B2
(45) Date of Patent: Jun. 27, 2006

(54) HYDRAULIC EARTH-MOVING BUCKET WITH LATERAL TILTING MECHANISM

(75) Inventors: Joel V. Risch, Eureka, CA (US); Aaron Tempelaere, Eureka, CA (US)

(73) Assignee: Amulet Manufacturing Company, Arcata, CA (US)

( * ) Notice: Subject to any disclaimer, the term of this patent is extended or adjusted under 35 U.S.C. 154(b) by 31 days.

(21) Appl. No.: 10/927,422

(22) Filed: Aug. 25, 2004

(65) Prior Publication Data

US 2006/0045714 A1 Mar. 2, 2006

(51) Int. Cl.
*E02F 3/00* (2006.01)

(52) U.S. Cl. ..... 414/722; 37/444

(58) Field of Classification Search ..... 414/722, 414/723, 724, 725, 729; 37/444, 411, 406
See application file for complete search history.

(56) References Cited

U.S. PATENT DOCUMENTS 3,203,565 A * 8/1965 Keskitalo ..... 414/705
3,419,171 A 12/1968 Isaksen
3,556,330 A 1/1971 Keskitalo et al.
3,871,538 A 3/1975 Miller et al.
4,042,131 A 8/1977 Buttke
4,080,746 A 3/1978 Frazzini
4,274,797 A 6/1981 Coon
4,906,161 A * 3/1990 Weyer ..... 414/705
4,999,022 A 3/1991 Veys
5,141,288 A 8/1992 Smith
5,901,480 A * 5/1999 Shamblin ..... 37/444
5,964,301 A 10/1999 Glasgow

* cited by examiner

*Primary Examiner*—Donald Underwood
(74) *Attorney, Agent, or Firm*—M. Henry Heines; Townsend and Townsend and Crew, LLP

(57) ABSTRACT

A laterally tiltable bucket for earth-moving equipment and the like is constructed with a flat plate of unitary construction attached to, and extending the full width of, the bucket, as a support for one or a pair of hydraulic cylinders whose axes are arranged parallel to the flat plate. When two cylinders are used, the pistons of the cylinders meet at a common linkage in the center. Various additional features, including construction of load-bearing portions of the bucket and the bracket to which the bucket is mounted, are joined at right-angles to simplify construction and increase the strength of the assembly.

9 Claims, 7 Drawing Sheets

HYDRAULIC EARTH-MOVING BUCKET WITH LATERAL TILTING MECHANISM

BACKGROUND OF THE INVENTION

1. Field of the Invention

This invention resides in the field of materials handling equipment used in the construction industry or related industries where earth moving or materials loading is performed. In particular, this invention addresses buckets such as those used on tractors, rubber-tired loader backhoes, and track- or wheel-mounted excavators, and heavy machinery in general that is designed for lateral tilting in addition to vertical tilting.

2. Description of the Prior Art

The term "backhoe" generally refers to a boom with a normally vertical arm pivotally mounted to one end and a rectangular bucket pivotally mounted to the end of the arm, the boom itself being pivotally mounted at its other end to a power source. The combination of boom, arm and bucket is able to pivot within a single plane, forward or back, and in many cases the bucket can be pivoted laterally as well. The term "loader," or particularly "front loader," generally refers to a tractor that has a wide rectangular bucket mounted to its front end. The term "loader backhoe" generally refers to a tractor that has a loader with a wide rectangular bucket on the front and a backhoe on the rear, the backhoe being able to swing right or left over a range of no more than 200 degrees. The term "excavator" generally refers to a backhoe mounted singularly to a power source, the entire upper structure of the backhoe being able to rotate right or left over a range of 360 degrees. Each of these types of machinery are designed for scooping, lifting, moving, and depositing material such as sand, soil, gravel, and mud, and in some cases transporting materials to or from a worksite. Loading and unloading functions of a bucket are typically performed by a vertical tilting movement, i.e., tilting about an axis parallel to the width of the bucket. In certain applications, this vertical tilting is sufficient. In others, however, such as those involving an uneven terrain or areas with narrow access, tilting from side to side, or lateral tilting, is also needed. For these applications, lateral tilting buckets that are operated by hydraulic mechanisms are used. Descriptions of buckets for loaders, backhoes, and excavators are found in the following United States patents:

- U.S. Pat. No. 5,964,301 to Glasgow, K. E., issued Oct. 12, 1999
- U.S. Pat. No. 4,080,746 to Frazzini, T. G., issued Mar. 28, 1978
- U.S. Pat. No. 4,999,022 to Veys, J. M., issued Mar. 12, 1991
- U.S. Pat. No. 4,906,161 to Weyer, P. P., issued Mar. 6, 1990
- U.S. Pat. No. 4,274,797 to Coon, D. B., issued Jun. 23, 1981
- U.S. Pat. No. 4,042,131 to Buttke, F. P., issued Aug. 16, 1977

Lateral tilting mechanisms complicate the construction of the bucket since they typically require hydraulic components that must be securely mounted and aligned, and they must be able to withstand strong impacts and forces and handle heavy loads without damage to the mechanism. Mechanisms that require this level of strength and durability while providing freedom of rotation in several different directions result in equipment that is expensive to manufacture and unwieldy in construction.

SUMMARY OF THE INVENTION

The present invention resides in a bucket and lateral tilting assembly for front loaders, backhoes, and excavators that is relatively simple and inexpensive to manufacture and highly durable in construction. A flat plate that extends substantially the full width of the bucket is mounted to an exterior surface of the bucket. The flat plate is unitary in construction, i.e., constructed as a single piece of metal, preferably steel, and serves as a common mounting support for a hydraulic cylinder or a pair of hydraulic cylinders that provide the lateral tilting mechanism and a head bracket that joins the flat plate, and hence the bucket, to the tractor. The hydraulic cylinder is pivotally mounted to the plate through a pivot pin perpendicular to the plate. When two hydraulic cylinders are present, the ends of the hydraulic cylinders are pivotally mounted to the plate at locations toward the ends of the plate and hence toward the two ends of the bucket along its width, and associated with the cylinders are rods or pistons each having one end (an outer end) inside its cylinder and the other end (an inner end) extending toward the centerline of the plate. The inner ends of the pistons and the plate itself are all mounted to the head bracket, the plate at a separate pivotal connection along the plate centerline. The site where the plate forms this separate pivotal connection is offset from the sites where the two pistons are mounted, thereby allowing a reciprocating movement of the two pistons to translate into a pivotal movement of the flat plate and hence the loader bucket relative to the head bracket. This use of a common mounting plate for the cylinder (or two cylinders) and the head bracket simplifies the construction and assures proper placement of the cylinders, eliminating the need for alignment of the cylinders after they are mounted to the bucket. The plate also increases the strength and rigidity of the bucket and protects the cylinders from impact. In preferred embodiments of the invention, the flat plate is one wall of a housing mounted to the top of the bucket, protecting the cylinders from the front, back and sides. In particularly preferred embodiments, the plate forms part of a housing or enclosure that contains the hoses for the hydraulic cylinders and protects them from damage due to external impacts.

In further preferred embodiments of the invention, the exposed front edges along the sides of the bucket are constructed as parallel plates, forming right angles with the top and bottom of the bucket. The side walls of the bucket in certain embodiments also include rear panels that are angled inward toward the back of the bucket. In either case, the parallel plates bordering on the opening at the front of the bucket provide the bucket with added durability and cutting strength due to the parallel relation to each other and their right-angle relation to the top and bottom of the bucket. In still further preferred embodiments, the head bracket is constructed of planar components all oriented either parallel to or at right angles to each other, further simplifying the construction and strengthening the assembly.

Still further embodiments, features, and advantages of the invention will be apparent from the description that follows.

DETAILED DESCRIPTION OF THE INVENTION AND PREFERRED EMBODIMENTS

While the concepts and features that define the present invention can be implemented in a variety of configurations and constructions, a general understanding of these concepts and features can be gained by a detailed study of one particular embodiment. The attached drawings and the following description focus on one such embodiment. This embodiment is a backhoe bucket assembly, but its features can also be applied to a front loader bucket assembly or an excavator bucket assembly.

Figure 1:
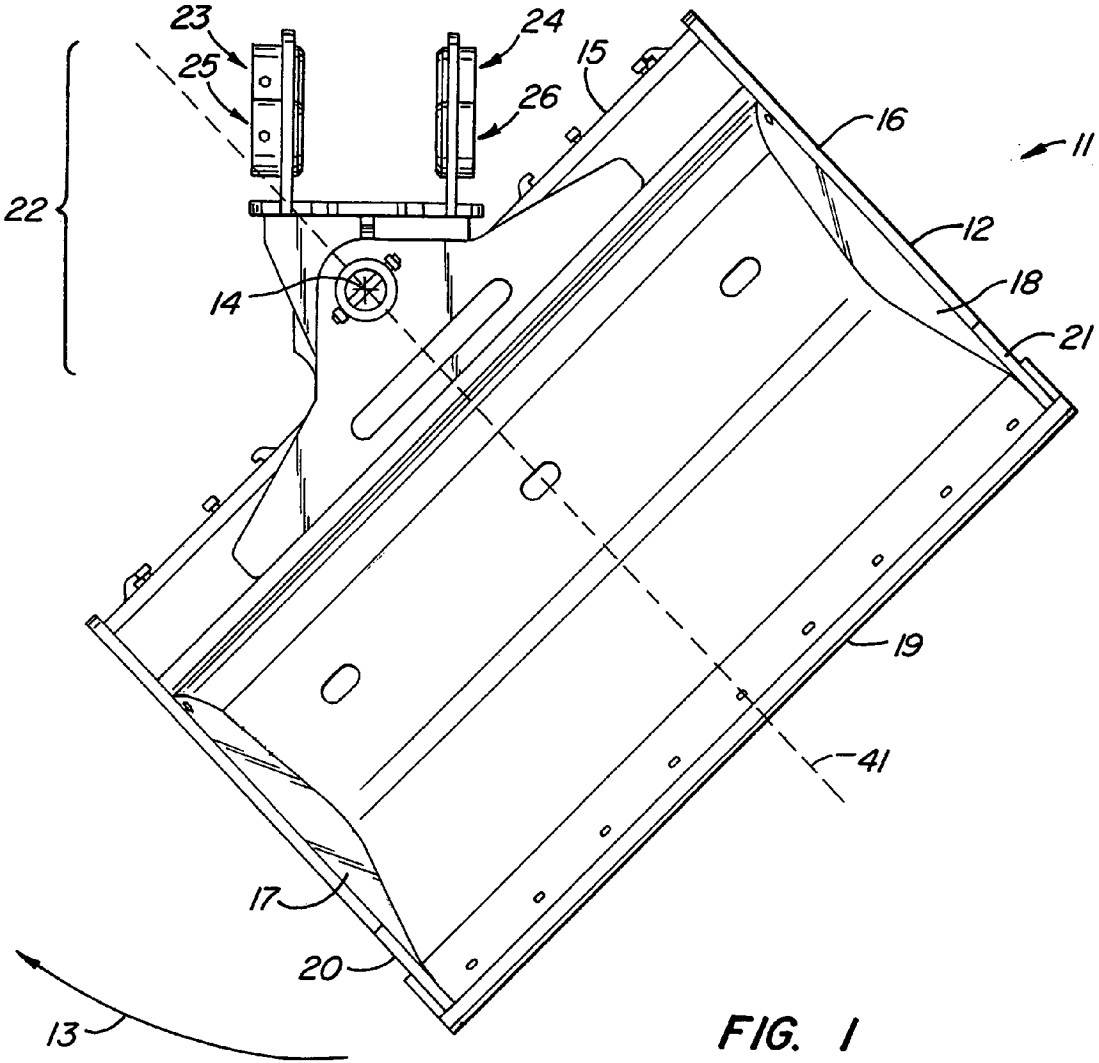
FIG. 1 is a front view of a bucket and tilting assembly in accordance with the present invention.

FIG. 1 depicts a backhoe bucket assembly 11 in accordance with the present invention, in a view that shows the backhoe bucket 12 laterally tilted to one side. The curved arrow 13 at the bottom of the drawing indicates the arc of movement of the bucket during lateral tilting. The bucket preferably has a fixed range of motion, such as for example 45° in either direction from a untilted position for a total pivot range of 90°, or any other angle selected by the manufacturer. Stops, shown in subsequently numbered drawings and discussed below, are provided in the structure to set the limits of the range. The pivoting occurs about a pivot point 14 at the top 15 of the bucket. The axis of rotation for lateral tilting thus passes through the pivot point 14 and is perpendicular to the plane of the figure. The bucket is formed from a contoured skin 16 that forms the ceiling, back wall, and floor of the bucket when the bucket is turned so that its opening is forward as shown rather than up, and the bucket is closed at the sides with side walls 17, 18. When the bucket is used in a cutting or digging operation, the cutting surfaces are the leading edge 19 of the bucket floor and the leading edges 20, 21 of the side walls. As shown in subsequent drawings and for reasons explained below, the leading edges 20, 21 of the side walls in this particular embodiment are curved for a portion of their lengths rather than linear.

A mechanical connection at the pivot point 14 on the top of the bucket assembly joins the assembly to a header bracket 22 which is the mounting by which the bucket assembly is joined to the tractor. Parallel pairs of openings 23, 24, 25, 26 receive mounting bars (not shown) that are manipulated by a hydraulic or other operator-controlled mechanism to achieve the vertical tilting of the bucket, which occurs about an axis (likewise not shown) that is within the plane of the figure and perpendicular to (although not intersecting) the axis about which the lateral tilting occurs.

Figure 2:
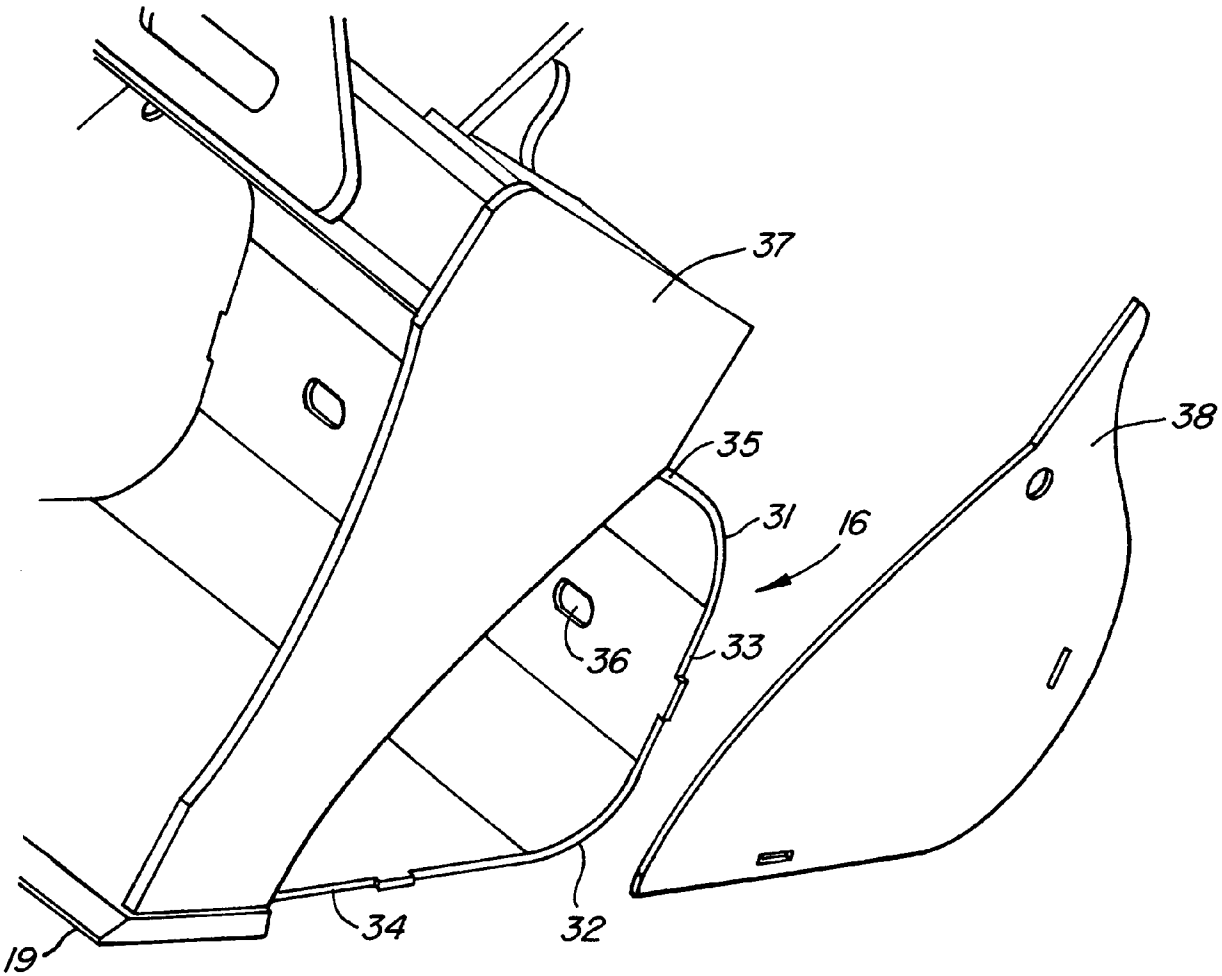
FIG. 2 is a perspective view of one side of the bucket of FIG. 1 with one portion the side wall broken away.

A view of the side wall 18 on one side of the loader bucket is shown in perspective and disassembled form in FIG. 2, which also shows the contour of the skin 16. The profile of the skin 16 has two curves 31, 32 with a flat section 33 in between, and a flat bottom 34 and flat top 35. The two curves separated by the flat section 33 increase the capacity of the bucket. Holes 36 are partially cut in the flat section to provide the user with the option of punching them out to permit drainage. The side wall is in two sections, a front panel 37 and a back panel 38, shown separated in this figure for clarity and to show the profile of the skin 16. The two panels are not parallel, but rather at a slight angle to each other, with the front panels on each side of the bucket parallel to each other and perpendicular to the leading edge 19 of the bucket floor, and the back panels on each side angled toward each other to form a slight taper in the bucket toward the flat section 33 of the skin. The parallel orientation of the front panels gives the leading edge of the side walls greater cutting or digging strength, which is useful for example against compacted soil formations, while the tapering orientation of the back panels improves the emptying of the bucket.

Figure 3:
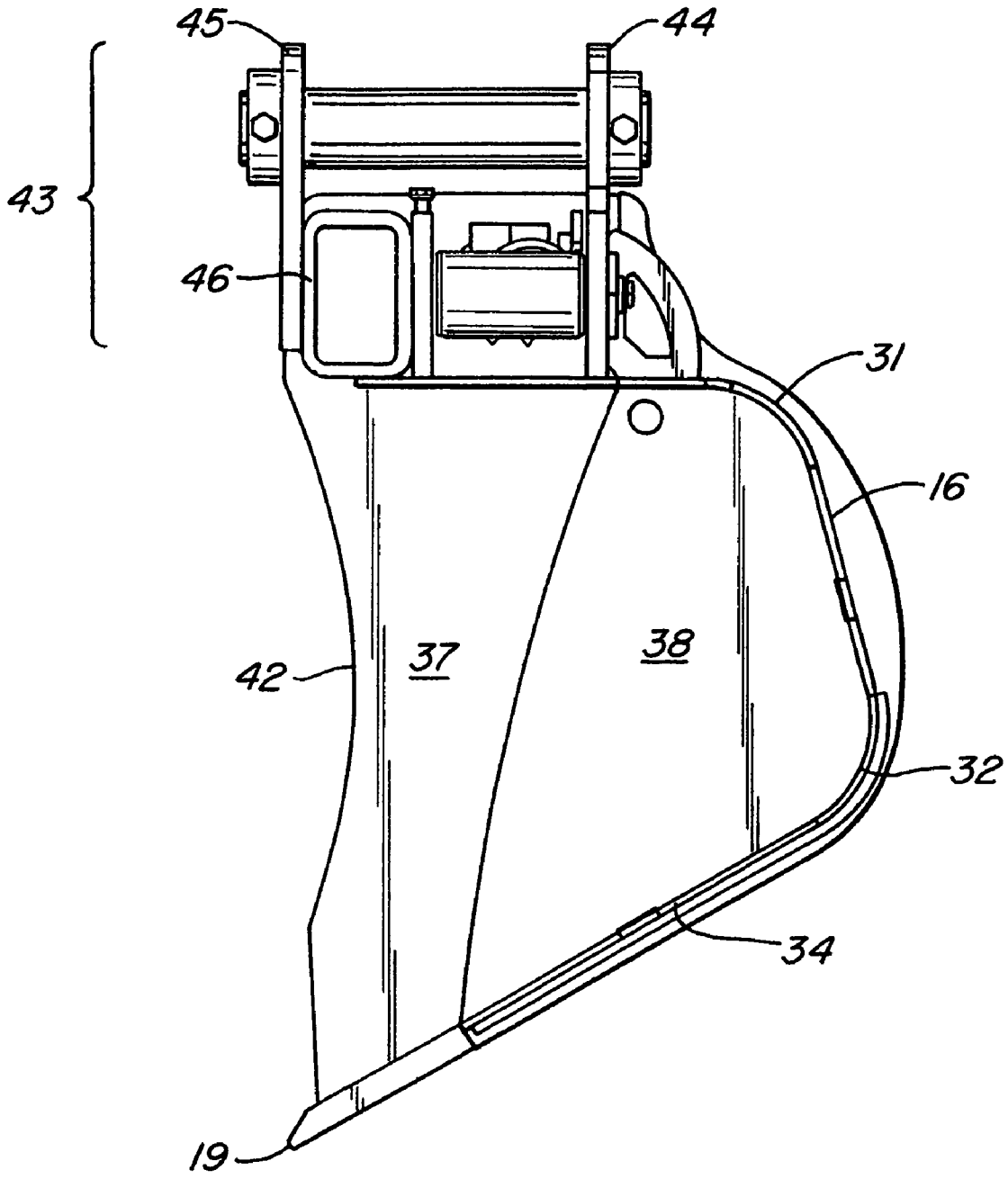
FIG. 3 is a cross section of the bucket and tilting assembly of FIG. 1 along the central plane of the assembly.

The bucket assembly is symmetrical about a central plane which is indicated in FIG. 1 by a centerline 41. The central plane includes the centerline 41 and extends perpendicular to the plane of the Figure. A longitudinal cross section of the loader bucket assembly along the centerline 41 of the bucket (FIG. 1) and hence the central plane is presented in FIG. 3, illustrating the shape of the bucket skin 16 with its two curves 31, 32, and also showing the bucket floor 34, the leading edge 19 of the bucket floor, and the front 37 and back 38 panels of one of the side walls. The floor 34 of the bucket is flat and long to provide a stable base, allowing the entire bucket assembly to rest on a horizontal surface without rolling over. The front panel 37 of the side wall has a curve 42 in its forward edge. This curve and a similar curve in the front panel on the other side together form a depression against which an object such as a log can be positioned and held in place by a "bucket thumb" or front attachment (not shown) that pivots down over the front opening of the bucket. The bucket thumb can be optional and removable.

Mounted to the top of the bucket is a support structure 43 that includes the lateral tilting mechanism, the various pivot connections, and other structural features providing mechanical support to the assembly. The flat plate 44 referred to above forms the rear wall of the structure, while a second flat plate 45 serves as the front wall. The primary structural element in the support structure is a rectangular tube 46 that extends the entire width of the bucket. The front side panels 37 are secured to the ends of the rectangular tube 46, as is the top of the skin 16 and extend above the upper skin of the bucket to provide additional support for the support structure 43. The additional components in the housing, which are discussed in detail below, include the lateral tilting mechanism.

Figure 4:
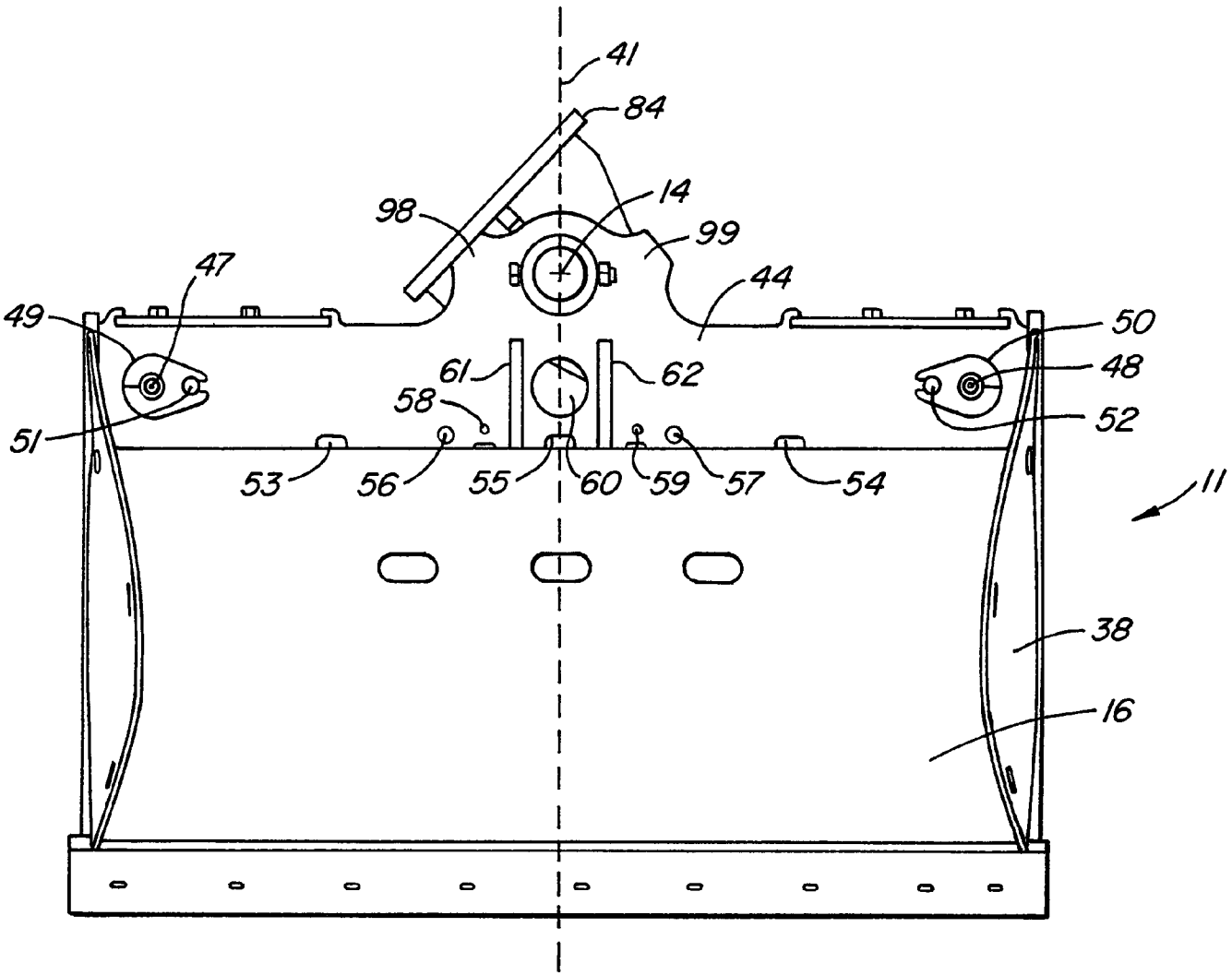
FIG. 4 is a rear view of the bucket and tilting assembly of FIG. 1.

A detailed view of the rear flat plate 44 is seen in FIG. 4, where the plate is shown from the rear. The plate is symmetrical about its centerline 41. A key feature of the plate is its width, which extends the full width of the bucket 11. Mounting holes in the plate provide three pivot axes, one 14 as mentioned above in the description of FIG. 1 serving as the pivot axis for the lateral tilting of the bucket. The remaining two mounting holes 47, 48 are for the hydraulic cylinders that control the lateral tilting position. Although the cylinders are not visible in this view since they are behind the plate 44, the transverse pins at the outer ends of the cylinders (by which the cylinders pivot) are mounted through these mounting holes 47, 48, and the cylinders extend inward in the direction of the plate centerline 41, with the cylinder pistons both terminating at the centerline. Other features in the plate 44 are washers 49, 50 for the cylinder mounting pins, retainer holes 51, 52 for the washers, drainage openings 53, 54, 55 access holes 56, 57 for hydraulic hoses for the cylinders, hose tie holes 58, 59, a further access hole 60, and support braces 61, 62 providing further securement of the plate 44 to the top of the bucket.

Figure 5:
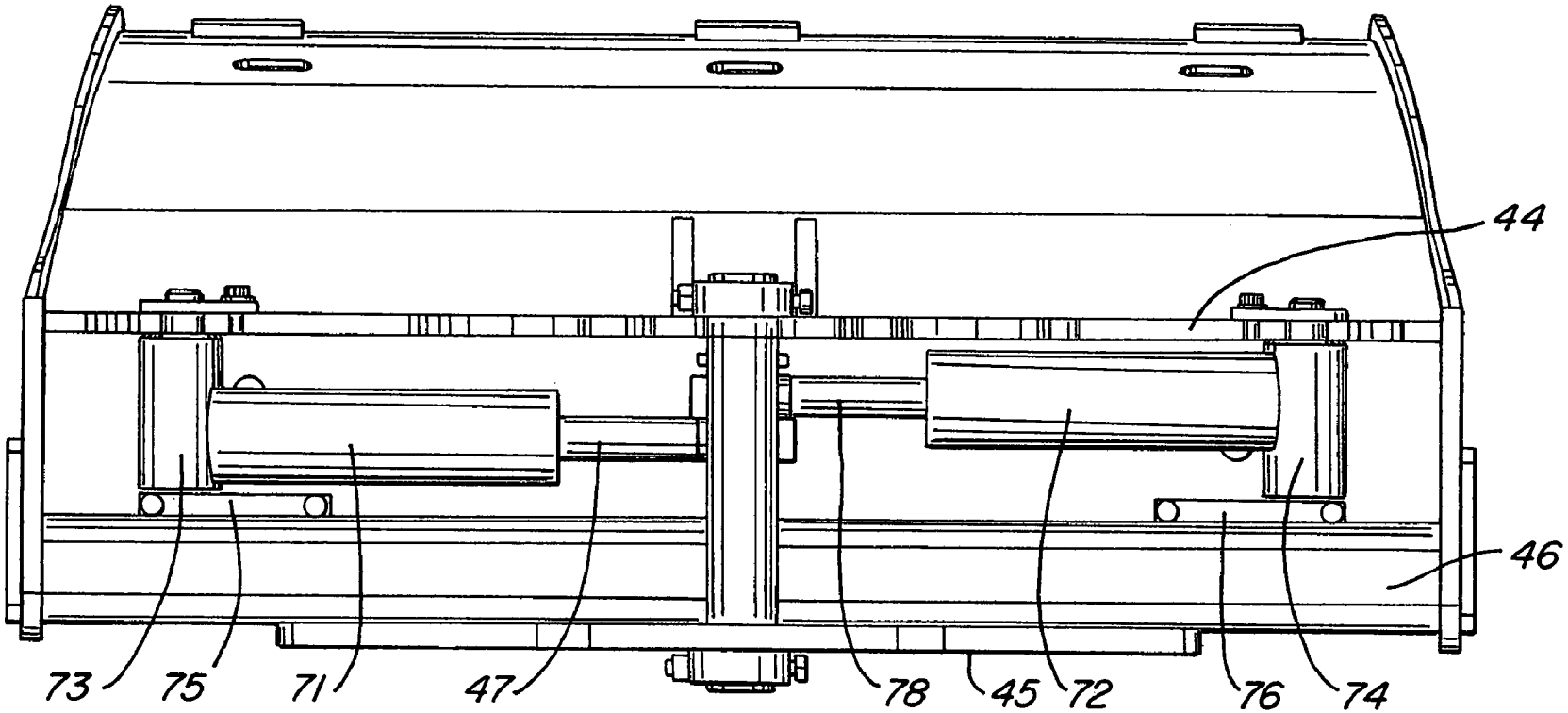
FIG. 5 is a top view of the bucket and tilting assembly of FIG. 1.

FIG. 5 is a top view of the support structure 43 showing the interior of the structure. The two hydraulic cylinders 71, 72 terminate at their outer ends in base cylinders 73, 74 that are mounted through pivot pins to the rear flat plate 44 at the rear and to two smaller plates 75, 76 at the front. The two smaller plates 75, 76 are secured to the rectangular tube 46. The pistons 77, 78 extend inward to the center of the structure. The cylinders and pistons in this embodiment are offset so that the pistons can both be joined to the head bracket (not shown in FIG. 5).

Figure 6:
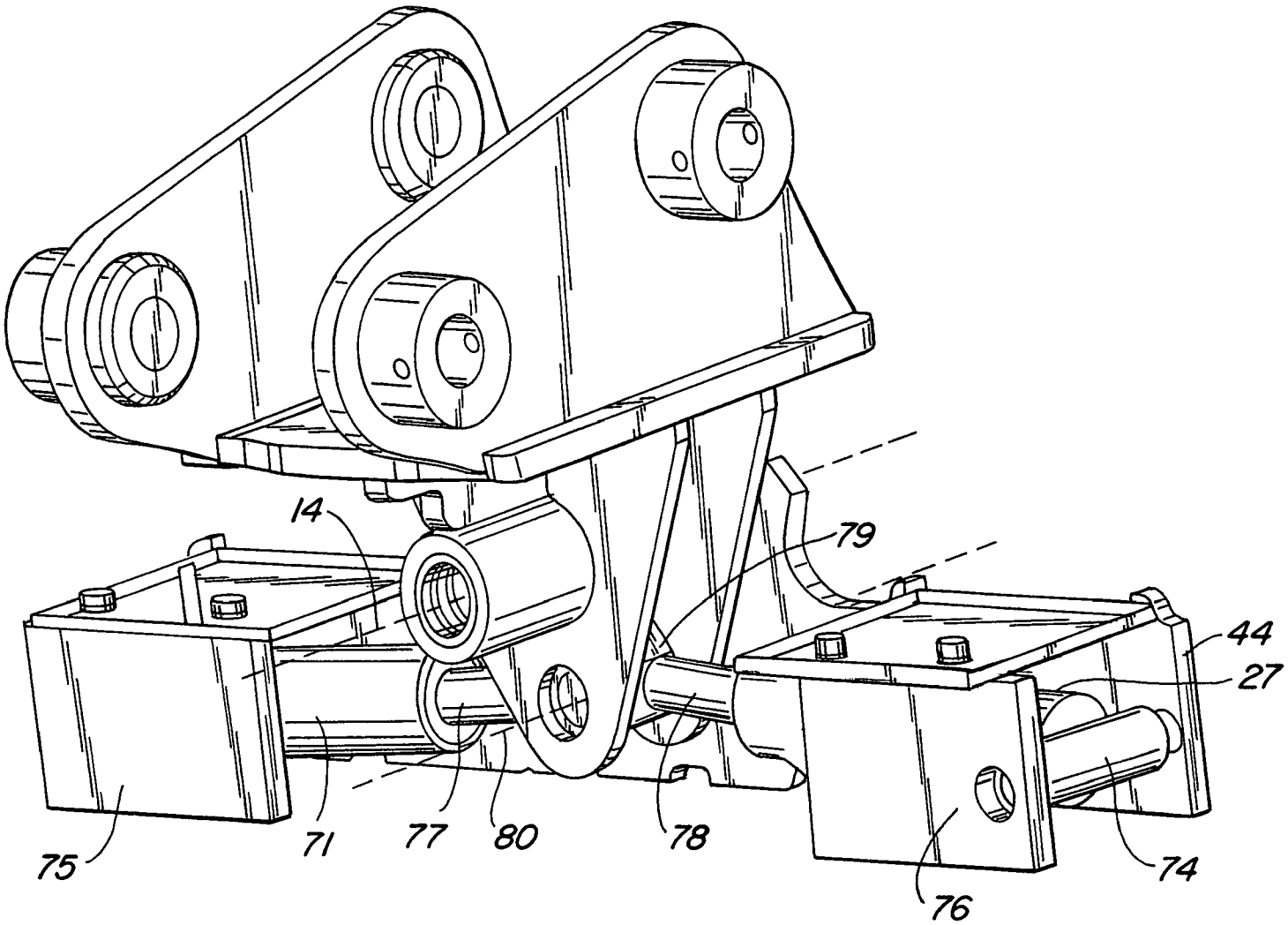
FIG. 6 is a perspective view of the head bracket and tilting mechanism of the assembly of FIG. 1.

The tilting mechanism itself, including the head bracket, is shown in FIG. 6. The inner ends of both pistons 77, 78 are mounted to the head bracket through a coupling 79 that is rotatable around an axis 80. This axis is offset from the axis 14 along which the rear flat plate 44 and the front flat plate 45 (shown in FIGS. 3 and 5 but not shown in FIG. 6) are pivotally mounted to the head bracket 22. While the head bracket itself does not pivot laterally, the pistons 77, 78 operate in a reciprocating manner, i.e., one piston extends as the other retracts and vice versa. This reciprocating movement causes the cylinders, the entire support structure in which the cylinders reside (including the front 45 and rear 44 plates), and therefore the bucket itself, to pivot about pivot axis 14.

Figure 7:
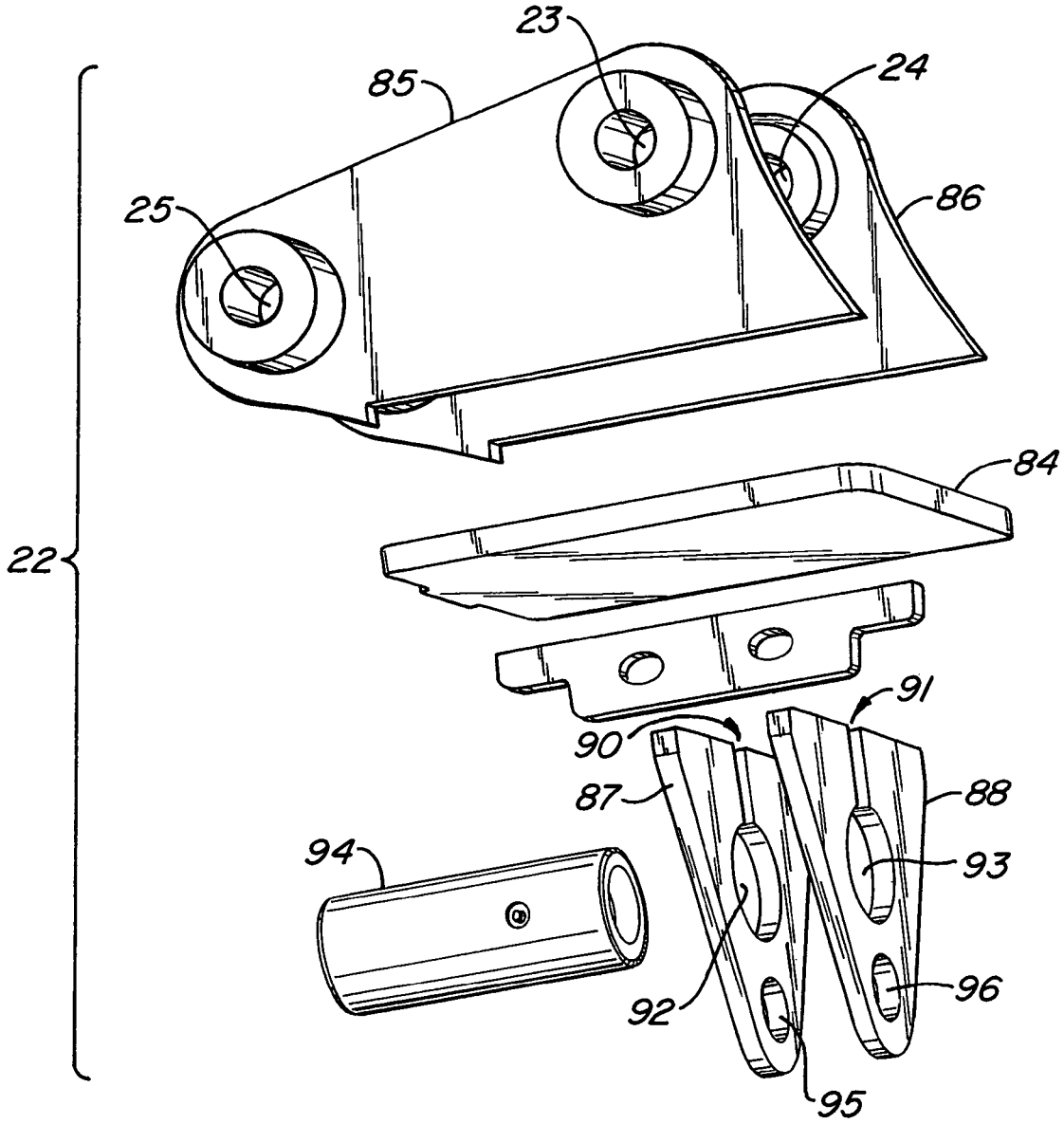
FIG. 7 is an exploded view of the head bracket of FIG. 6.

The construction of the head bracket 22 is readily seen in the exploded view presented in FIG. 7. The bracket includes a platform 84 with a pair of struts 85, 86 secured to its upper surface. The struts 85, 86 contain the openings 23, 24, 25, 26 referred to in the description above of FIG. 1 (although only three of the four are visible in FIG. 7), and as explained above, these openings receive the mounting pins (not shown) whose movement causes the vertical tilting of the bucket. A pair of downwardly extending supports 87, 88 are secured to the underside of the platform 84 and an interlocking member 89 mates with slots 90, 91 in the supports for added strength. All of these parts are welded together. The downward supports 87, 88 each have a pair of circular holes, with corresponding holes aligned to allow rotating bars to pass through. The upper holes 92, 93 accommodate a pin 94 by which the front 45 and rear 44 plates (FIGS. 3 and 5) are mounted to the head bracket, and the bar 94 rotates within these holes as the bucket undergoes lateral tilting. The lower holes 95, 96 accommodate the coupling 79 (FIG. 6) to which the ends of the pistons 77, 78 (FIG. 6) are mounted.

The platform 84 (with the upper struts removed) is also visible in FIG. 4, which shows the rear of the flat plate 44 behind the pistons. The platform extends over the upper edge of the flat plate, and this view of the plate shows that the upper edge of the plate is contoured with two projections 98, 99 that will abut the underside of the platform at the extreme ends of the pivot range of the bucket assembly and thereby serve as stops for the pivot range.

The foregoing is offered primarily for purposes of illustration. Further variations in the contours, shapes, and relative dimensions and sizes that are still within the scope of the invention will be apparent to those skilled in the art.

What is claimed is:

1. A bucket and tilting assembly for hydraulically operated lateral tilting of said bucket, said assembly comprising:

a bucket having an elongated width and a central plane perpendicular to said width;

a flat plate mounted to an exterior surface of said bucket and extending substantially said full width of said bucket;

an hydraulic cylinder pivotally mounted to said flat plate through a first pivot pin perpendicular to said flat plate;

said flat plate pivotally mounted to a head bracket by a second pivot pin in said central plane; and a piston extending from said hydraulic cylinder to a linkage that is offset from said second pivot pin whereby movement of said piston relative to said hydraulic cylinder translates to pivotal motion of said bucket relative to said head bracket.

2. The assembly of claim 1 wherein said hydraulic cylinder is defined as a first hydraulic cylinder and said piston is defined as a first piston, and said assembly further comprises a second hydraulic cylinder and a second piston extending from said second hydraulic cylinder, said second hydraulic cylinder pivotally mounted to said flat plate through a third pivot pin perpendicular to said flat plate, said first and third pivot pins located on opposing sides of said central plane, and said first and second pistons joined to a common linkage that is offset from said second pivot pin, whereby reciprocating movement of said first and second pistons relative to said hydraulic cylinders translates to pivotal motion of said bucket relative to said head bracket.

3. The assembly of claim 1 further comprising projections on said flat plate, said projections positioned to alternately abut said head bracket at two locations thereon, thereby serving as stops limiting said bucket to a defined pivot range.

4. The assembly of claim 1 wherein said bucket has an opening extending its full width and is capped at both ends along its width with side cutting plates having portions adjacent to said opening that are parallel to each other and perpendicular to said flat plate.

5. The assembly of claim 4 wherein said side cutting plates have concave leading edges.

6. The assembly of claim 2 wherein said flat plate is a rear plate of a housing mounted to said exterior surface of said bucket, and said first and second hydraulic cylinders are contained within said housing.

7. The assembly of claim 2 in which said first and second hydraulic cylinders are offset from each other.

8. The assembly of claim 6 wherein said housing is mounted to a top surface of said bucket.

9. The assembly of claim 6 wherein said housing contains openings positioned to provide drainage for liquids entering said housing.

* * * * *